US005287670A

United States Patent [19]

Funaki

[11] Patent Number: 5,287,670

[45] Date of Patent: Feb. 22, 1994

[54] DOUBLE ROOFING ROOF STRUCTURE

[75] Inventor: Motokatsu Funaki, Kanagawa, Japan

[73] Assignee: Gantan Beauty Industry, Co., Ltd., Kanagawa, Japan

[21] Appl. No.: 671,442

[22] Filed: Mar. 19, 1991

[30] Foreign Application Priority Data

Oct. 18, 1990 [JP] Japan ..... 2-277717
Dec. 19, 1990 [JP] Japan ..... 2-403674

[51] Int. Cl.[5] ..... E04D 1/34

[52] U.S. Cl. ..... 52/544; 52/478; 52/520

[58] Field of Search ..... 52/543, 544, 520, 521, 52/522, 698, 478

[56] References Cited

U.S. PATENT DOCUMENTS

| | | | |
|---|---|---|---|
| 3,309,829 | 3/1967 | Berridge | 52/521 |
| 3,667,185 | 6/1972 | Maurer | 52/478 X |
| 4,074,492 | 2/1978 | Simpson et al. | 52/544 X |
| 4,285,182 | 8/1981 | Dinges | 52/478 |
| 4,406,106 | 9/1983 | Dinges | 52/543 X |
| 4,441,295 | 4/1984 | Kelly | 52/408 |
| 4,466,224 | 8/1984 | Hague | 52/544 X |
| 4,649,684 | 3/1987 | Petree et al. | 52/520 X |
| 4,651,493 | 3/1987 | Carey | 52/710 |
| 4,833,853 | 5/1989 | Diebele et al. | 52/520 X |

FOREIGN PATENT DOCUMENTS

| | | |
|---|---|---|
| 1212218 | 10/1986 | Canada . |
| 3526080 | 1/1987 | Fed. Rep. of Germany . |
| 60-215963 | 10/1985 | Japan . |

*Primary Examiner*—Carl D. Friedman
*Assistant Examiner*—Kien Nguyen
*Attorney, Agent, or Firm*—Sandler Greenblum & Bernstein

[57] ABSTRACT

A double roofing structure in which a water-proof drain plate is set on a backing. The rafter is fixed on the backing through the drain plate with a fixing member. Roof material or roof material holding member and inner layer material are placed and fixed on the rafter. A spacing layer communicating with an opening of the eaves is formed between the drain plate on the backing and the roof plate. The part communicating with the fixing member in the drain plate is formed with a projection.

17 Claims, 19 Drawing Sheets

DOUBLE ROOFING ROOF STRUCTURE

BACKGROUND OF THE INVENTION

1. Field of the Invention

This invention relates to a water-sealed structure of a roof.

2. Description of the Prior Art

The present inventor invented and filed the invention in Jap. Pat. Appln. No. 69995/1984 (Jap. Pat. Laid-Open No. 215963/1985) in order to prevent a so-called "water leakage" generated by an accumulation of snow on a roof in a cold weather district such as a snow country and further to prevent leakage of water by applying a water-proof plate and the like. That is, in the prior art invention, as shown in FIG. 31, it is constructed such that a lower inner material (12) is arranged on a supporting member (11) such as a main house, an upper inner layer material (21) is arranged and fixed to a fixing member (25) comprised of a rafter (19) fixed on the lower inner layer material (12) and of a fixing fitting (16) or the like, an air layer (22) is formed between the lower inner layer material (12) and the upper inner layer material (21), a roof plate (23) is placed on the upper inner layer material (21), a water-proof plate (14) is set on the lower inner layer material (12), both side edges (14*a*), (14*a*) of the water-proof plate (14) are pressed and held with the lower inner layer material (12) and the fixing member (25), and a drain port adjacent to eaves of the water-proof plate (14) and to cause the air layer (22) to be opened out of the roof.

However, the aforesaid invention has a disadvantage that rain water flowing down a metallic roof surface is accumulated to be stopped by strong wind under an abnormal environmental condition in which heavy rain fall in typhoon and local heavy rail fall together with a continuous strong wind occurs, resulting in that an edge part of the roof panel shows a flooding condition and then the rain water overflows the edge part to enter a room. That is, the overflown rain water enters from engaging claws (19*a*) of a metallic rafter (19) in FIG. 31 in a direction indicated by an arrow (A) and shows a problem that it enters from between the rised parts (14*a*) of the adjoining water-proof plates into a room.

In recent years, due to a trend of multi-versions of design and raw material for a roofing, some tiles or natural slates only used for ornamental purpose in a parapet in a building or the like are used as materials for a roof of a building. The tiles or natural slates have a water-proof function as a roofing material. However, under such a condition as one in which a strong wind may act at a high location of a top part of a building, a rain water-proof characteristic is not sufficient and so a roof structure having a sufficient and safe rain water-proof characteristic even under an application of these roof materials is requested.

It is frequently found that a wall structure of a building in particular a roof backing is of an iron backing. In addition, it is also found that the roof backing is composed of iron together with air-bubbled light-weight concrete (hereinafter called as ALC) and in case of a building of a medium-size or lower, the concrete surface (hereinafter called as RC) of which level is adjusted with mortar on RC is applied as a roof backing.

It is usually acknowledged that the building worked with this ALC or RC of a backing material hardly produces an accident of water leakage. However, in a practical work, it merely shows that ALC and RC have a water-absorbing characteristic and in turn they may keep water in it and may not pass it easily, so that water is hardly immersed into a room. Since the accident of water leakage in a building of ALC or RC is advanced as a crack caused by water in the backing is generated to cause the building itself to be weakened and influence against its structural strength. Once the water leakage occurs, a specifying of the water leakage position is quite difficult and an entire repairing of the leaked location is needed. It accompanies with a freezing disaster at a cold weather district and this becomes more severe problem.

SUMMARY OF THE INVENTION

It is an object of the present invention to provide a double roofing roof structure in which the aforesaid problems are overcome and a superior rain water preventing function is attained to enable a positive prevention of water leakage or leakage of rain water as well as snow melting water to be carried out even under an abnormal weather condition such as typhoon or storm and the like.

With such an arrangement as above, the following effects may be attained.

In case of storm, a wind pressure may act to cause a roof surface to be formed into a pool and even if there is an immersed amount of water exceeding the roof material, the immersed water flows down on the drain plate to the eaves due to the fact that there is the drain plate within a roof structure, and finally the water is discharged out of the building. The drain plate is formed with the projection, so that the immersed water may not ride over the projection and reach the backing. Since there is a spacing opened at the eaves, it is possible to eliminate at an early stage a wetting of a room in case of occurence of immersed water. In summer season, it is effective in improving a thermal insulating effect or a cooling effect and in winter season in a snow accumulated district, it is effective in preventing a water leakage at the eaves of accumulated snow. The backing can be protected against the rain water to prevent an accident of water leakage and at the same time the backing is made of ALC or RC, there is no crack caused by the water leakage, so that the building is not weakened at all and this type of roofing can be employed in a cold weather district. In addition, the drain plate is placed in a spacing where an influence of an external pressure is hardly applied under a condition in which a rain water-proofed state is complete. Accordingly, actually this arrangement constitutes the second roof plate. Due to this fact, even if the roof structure of the present invention is used in such a way as a rain water proofing with a tile, a flat slate and a solar panel or the like is not relatively high, but an approximate rain water proofing function and an external pressure shielding function are provided and further used as the first roof plate, it becomes possible to provide a safe roof structure with a high water-sealing function capable of sufficiently enduring against a severe special weather condition such as a typhoon or the like and further it may be widely used in a normal roof as well.

The present invention has an improvement in which the projection of the drain plate is formed in the plate part arranged within the rafter and formed into a form similar to a sectional shape of the pushing plate of a fixing member contacting with the projection and at the same time this projection is provided with a recess for a fixing element.

With such an arrangement, since the fixing member and the drain plate are closely overlapped to each other, an inside part of the rafter is approximately complete sealed, the immersed water may not enter the room, but flow down positively on the surface of the water leakage preventing plate and this water is discharged even under an abnormal weather condition such as typhoon and the like and under a condition in which the water enters from a clearance such as claws formed in a small screw, a bolt or a rafter for fixing the roof plate or its hanger into the rafter.

The present invention has an improvement in which the drain plate has rising portions at its right and left side edges and a projection is formed at a central part of it.

With such an arrangement as above, since a complete water-proofing at the projection can be attained, there is no possibility that the water is leaked from this projection into the backing.

The present invention has an improvement in which the drain plate has the rising portions at its right and left edges and the projection is formed while the rising portions are overlapped to each other below the rafter.

With such an arrangement, a plate strength of the drain plate is improved and a stable arranging of the plate to the backing can be assured.

In the present invention, it has an improvement in which the flat surface of the drain plate is provided with one or more ribs for supporting the roof material or the roof material and the roof material holding member or an inner layer material.

With such an arrangement, since the drain plate may be formed into a proper shape in correspondence with the object of use, it is quite convenient in performing the work and in particular, in case that one or more ribs for supporting the roof materials or the roof material holding members or the inner layer materials, it is possible to support a high load of the roof and to prevent a deformation or damage of the roof material or the inner layer material. In particular, it is effective for relative small block roof materials such as tile or slate and the like.

The present invention has an improvement in which some spacer materials having a substantial same shape as that of a spacing sectional shape formed by an inner side of the projection are placed in the projection inner part of the drain plate.

With such an arrangement as above, since it is possible to prevent a deformation of the projection caused by fixing of the fixed member, it is possible to increase an immersed water toward the backing side.

The present invention has an improvement in which a water-proof member such as a packing is held between a pressing plate for the fixing plate and an upper surface of the projection of the drain plate. With such an arrangement as above, it is possible to make an approximate complete water-sealing at the part of the fixing member. In addition, a strength of the fixing part is not deteriorated.

The present invention has an improvement in which the flanges of the rafter are closely contacted on the drain plate through the engaging part for the pressing plate for the fixing member.

With such an arrangement, it is possible to make a simple alignment of the pushing plates only by varying the heights of the supporting legs of the pushing plates without adjusting the height of the rafter to heights of air layers in various roofs The present invention has an improvement in which the flanges of the rafter are supported by the supporting portions of the pushing plates mounted on the drain plate and some spacings are formed just below the supporting portions.

With such an arrangement, even if the immersed water is found in the air layer due to a flat slate and a solar panel having no sufficient rain water-proofing function, the pushing plate supporting portions is not wetted with water, resulting in that there is no possibility that the pushing plate is corruded to decrease a supporting strength of the rafter and a safe state can be assured for a long period of time.

The present invention has an improvement in which the flange portions of the rafter are supported by the supporting parts of the pushing plate mounted on the drain plate, some spacings are formed just below the supporting portions and at the same time the pushing plate is supported on the drain plate by the supporting legs arranged in the pushing plate.

With such an arrangement as above, even if the immersed water for the air layers are present due to a flat slate and a solar panel having no sufficient rain water-proofing function caused by the spacings, the pushing plate supporting part is not wetted with water, resulting in that there is no possibility that the pushing plate is corrided and a supporting strength of the rafter is decreased and a safe state can be assured for a long period of time. In addition, it is possible to make a simple alignment of the pushing plate only by varying the height of the supporting legs of the pushing plates without aligning the height of the rafter with the height of an air layer in various types of roofs. Further, a strength of the rafter is not deteriorated.

The present invention has an improvement in which the rafter is provided with a step part between the upper end and the side surface.

With such an arrangement, the step part can be provided with an inner layer material, so that the roof material can be formed with the flat roof backing surface and at the same time any batten can be used.

The present invention has an improvement in which a thermal insulation material is placed between the backing and the drain plate.

With such an arrangement, it is possible to improve an external thermal insulation effect required in a modern building.

The present invention has an improvement in which the roof material is of metal, tile, slate and roof tile and the like.

With such an arrangement, the present invention may be adapted for almost of all roof materials and thus it is possible to get roof forms of various designs.

The present invention has an improvement in which the backing is of a shaped steel having a proper sectional shape and a lower inner layer material is placed on the backing. With such an arrangement, it is possible to form a roof of a building in which a frame assembly is of a shape steel.

The present invention has an improvement in which the backing is of an air-bubbled light weight concrete and a concrete mortar or the like. With such an arrangement, it is possible to form a roof of a building in which a main body is formed of an ALC panel or RC or mortar.

As the roof material in the present invention, there are following examples.

(1) A single embodiment in which a roof panel such as a metallic lateral roofing plate (2) An embodiment in which there is provided a combination of roof materials such as tile, slate and roof tile or the like and a roof material holding member such as a rail or a metallic sheet for holding the roof material (3) An embodiment in which there is provided a combination of a roof material such as a metallic lateral roofing plate and a roof material holding member such as a hanger for holding the roof material.

(4) An embodiment in which there is provided a combination of a roof material such as a metallic lateral roofing plate and an inner layer material such as a wood wool cement plate and the like (5) An embodiment in which there is provided a combination of a roof plate such as a metallic flat roofing plate and an inner layer material such as a veneer plate As the fixing means of the fixing member to fix the rafter to the backing, there are provided some embodiments in which the fixing members composed of the following anchors and the fixing members.

(1) In case of the embodiment using a female screw anchor, the female screw anchor is applied to the backing before setting the drain plate and then set the drain plate and the fixing member in compliance with a position of the female screw anchor, and a male screw bolt is fastened to fix it.

(2) In case of the embodiment in which the male screw anchor, the male screw anchor is set to the backing before applying the drain plate and then the drain plate and the fixing member are set from the backing to the male screw projected and they are fastened with nuts and fixed.

(3) In case of the embodiment using a striking anchor, the drain plate and the fixing member are set in compliance with a marking position of the backing, then the striking anchor is driven and fixed. The projection at the drain plate having a trapezoid section is preferable in view of its strength.

BRIEF DESCRIPTION OF THE DRAWINGS

FIG. 1 is a partial side elevation in section for schematically illustrating the roof structure of the present invention.

FIG. 2 is a front elevational view in longitudinal section of a substantial part.

FIG. 3 is an exploded perspective view for showing a fixing member.

FIG. 4 is a partial perspective view of a drain plate.

FIG. 5 is a partial perspective view for showing a modification of the drain plate.

FIGS. 6(*a*), (*b*) and (*c*) show a modification of the drain plate, respectively.

FIG. 7 is a front elevational view in section for showing a substantial part of a roof using the drain plate of FIG. 6(*a*).

FIGS. 8 and 9 are perspective views for showing a pushing plate.

FIG. 10 is a front elevational view of the drain plate for showing another modification.

FIG. 11 is a partial perspective view for showing an engaged state of the modification shown in FIG. 10.

FIG. 12 is a front elevational view in longitudinal section of a substantial part for showing a fixing condition.

FIG. 13 is a front elevational view in longitudinal section of a substantial part of the second preferred embodiment.

FIG. 14 is a perspective view for showing a pushing plate.

FIG. 15 is a front elevational view in longitudinal section of a substantial part of the third preferred embodiment.

FIG. 16 is a perspective view of a pushing plate.

FIG. 17 is a perspective view for showing a modification of a pushing plate.

FIG. 18 is a partial side elevational view in longitudinal section for showing the fourth preferred embodiment of a double roofing structure of the present invention.

FIG. 19 is an enlarged front elevational view in longitudinal section taken along a line 19—19.

FIG. 20 is a partial enlarged exploded perspective view for showing the fourth preferred embodiment.

FIG. 21 is an enlarged front elevational view for showing the drain plate of the fourth preferred embodiment.

FIG. 22 is an enlarged front elevational view in longitudinal section for showing the fifth preferred embodiment of a double roofing structure.

FIG. 23 is an enlarged perspective view for showing a fixing member of the fifth preferred embodiment.

FIG. 24 is an enlarged front elevational view in longitudinal section for illustrating the sixth preferred embodiment of a double roofing structure.

FIG. 25 is an enlarged front elevational view in longitudinal section for illustrating the seventh preferred embodiment of a double roofing structure.

FIG. 26 is an enlarged perspective view for showing a rafter of the seventh preferred embodiment.

FIG. 27 is an enlarged perspective view for showing a fixing member of the seventh preferred embodiment.

FIG. 28 is an enlarged front elevational view in longitudinal section for illustrating the eighth preferred embodiment of a double roofing structure.

FIG. 29 is an enlarged front elevational view in longitudinal section for illustrating the ninth preferred embodiment of a double roofing structure.

FIG. 30 is an enlarged front elevational view in longitudinal section for illustrating the tenth preferred embodiment of a double roofing structure.

DESCRIPTION OF THE PREFERRED EMBODIMENTS

Figure 1:
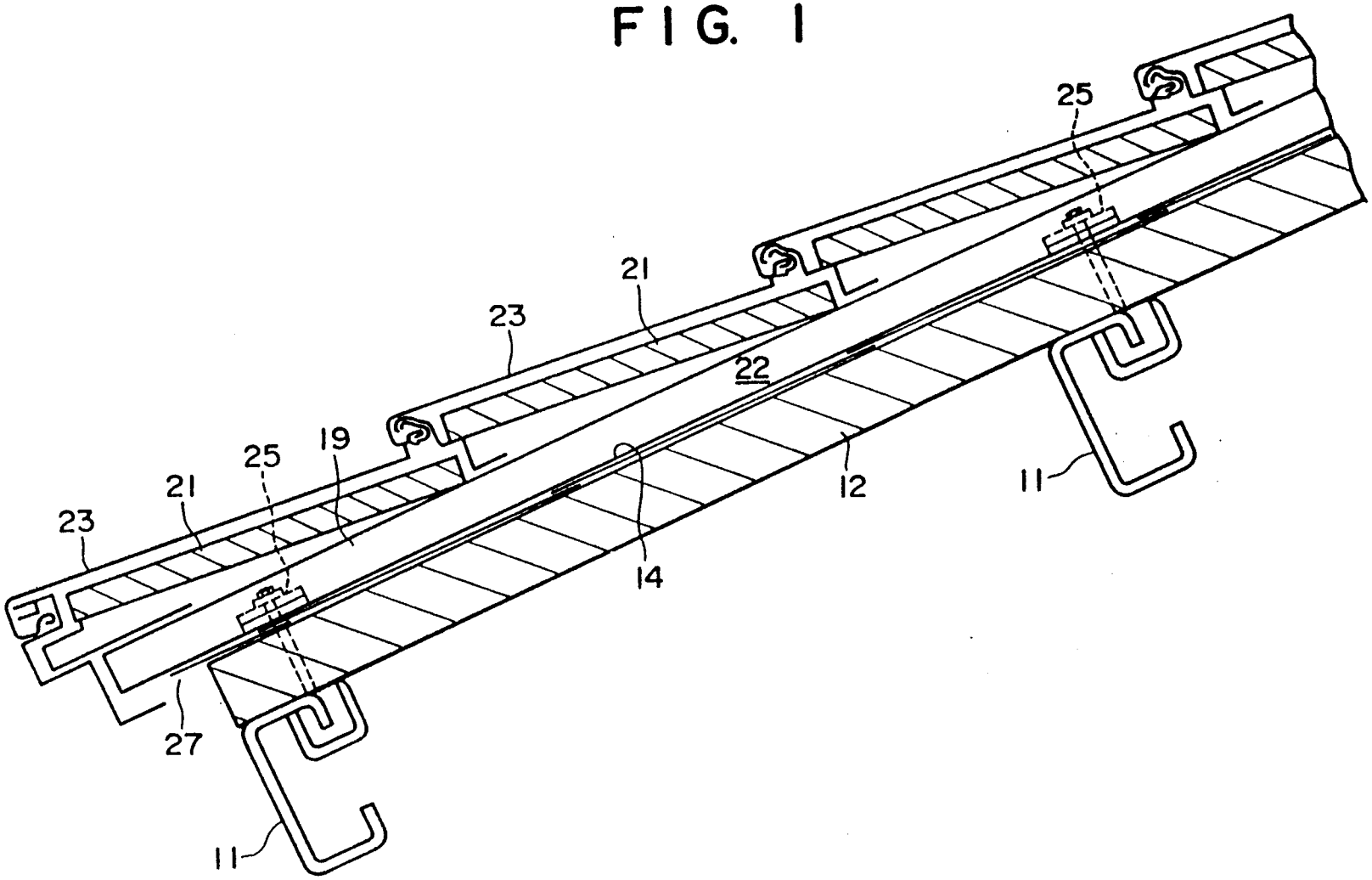
FIGS. 1 to 17 illustrate the preferred embodiments in which the backing is composed of a shape steel.

Referring now to the drawings, some preferred embodiments of the present invention will be described in detail.

FIGS. 1 to 4 illustrate the first preferred embodiment of the present invention.

In FIGS. 1 to 4, (11) denotes backings, i.e. housings composed of C-shaped steel and a lower inner layer material (12) is supported and arranged on the backings (11). The lower inner layer material (12) is made such that an asphalt felt (12*c*) is placed on a wood wool plate cement (12*b*), for example. A joint member (13) of a substantial reversed groove section supported on the backing (11) while being crossed at a right angle is fitted to a recess (12*a*) arranged at the lower part of the connection part of the lower inner layer material (12).

Figure 2:
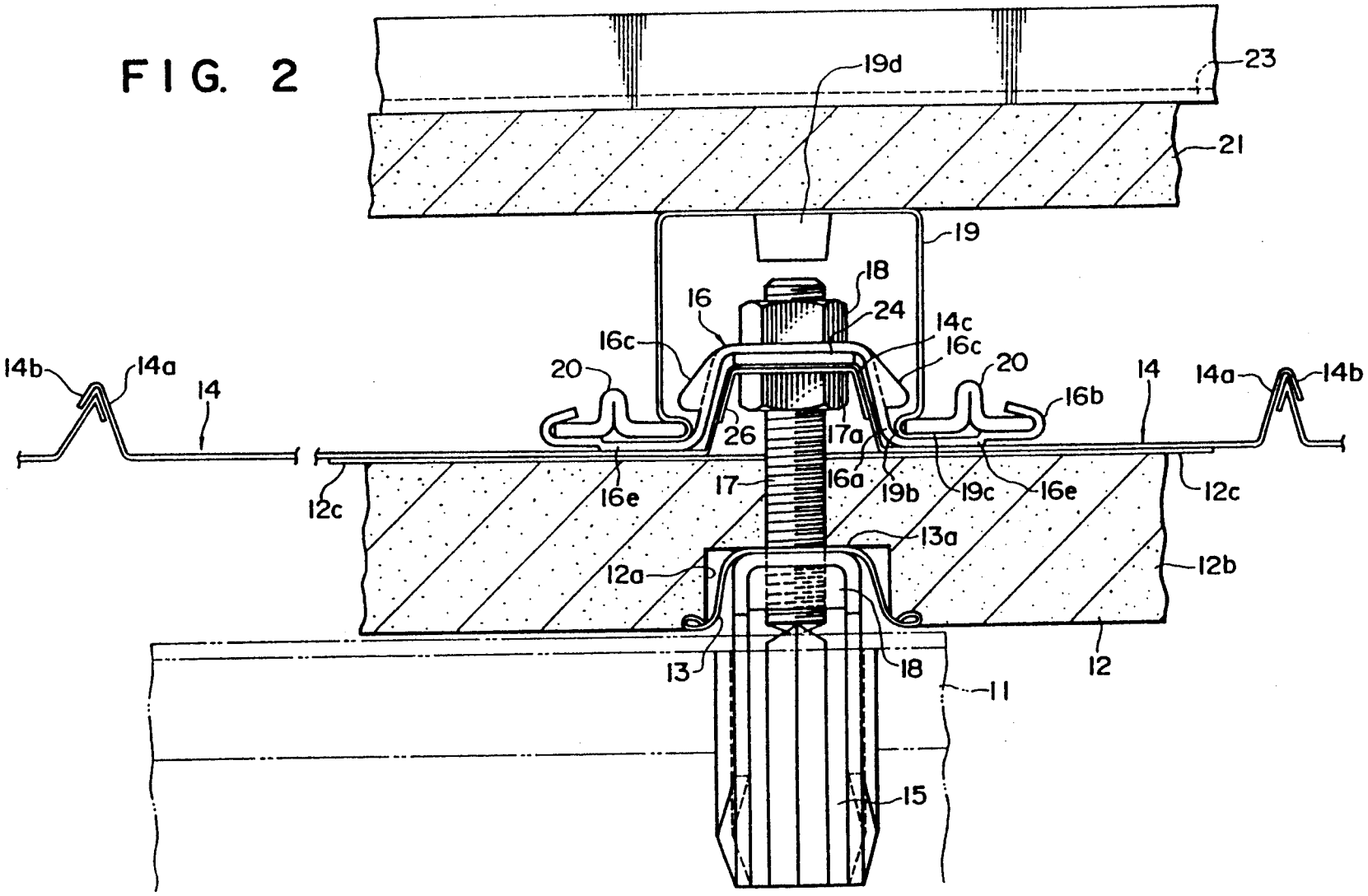
Figure 4:
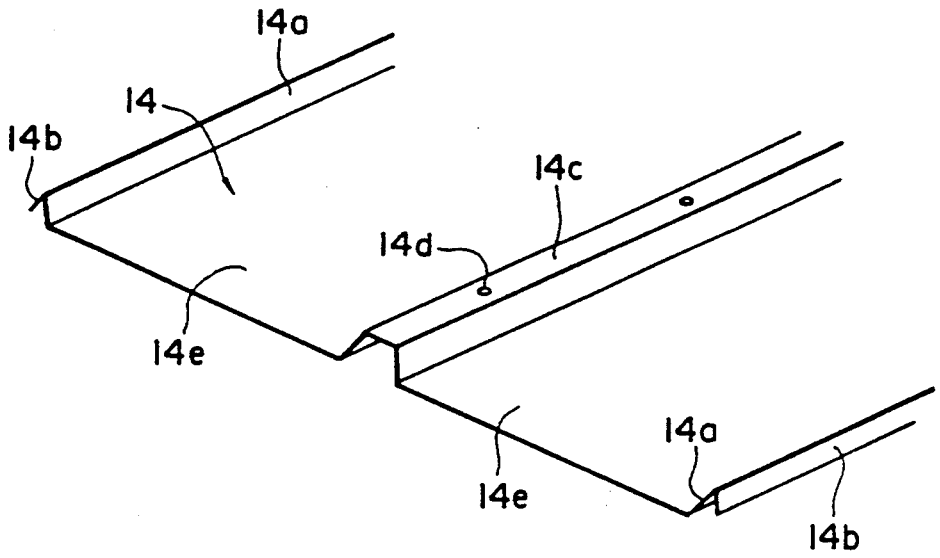

(14) denotes a drain plate and this drain plate (14) is placed over the lower inner layer material (12) over an entire surface ranging from the ridge of the roof to the eaves. The drain plate (14) is composed of water-proof material such as a quite thin plate or thick foil of metal such as iron, aluminum and a thin plate of synthetic resin or the like. As shown in FIG. 1, the drain plate (14) is divided into a plurality of segments in a direction toward the eaves and the eaves end of the drain plate (14) at the ridge is overlapped on the ridge end of the drain plate (14) divided at the eaves. In addition, as shown in FIG. 2 or FIG. 4, the drain plate (14) has a rising part (14*a*) bent at a larger angle than a right angle from both side edges upwardly and a bent part (14*b*) bent inwardly from the rising part (14*a*). (14*c*) denotes a projection of the drain plate and this projection (14*c*) is a part arranged in the rafter to be described later, and this is projected to a shape which is approximately similar to a sectional shape of the pushing plate of the fixing member to be described later. (14*d*) denotes recesses made at the aforesaid projection, wherein the recesses are bolt holes for use in passing the bolts therethrough. (14*e*) denotes flat surfaces and the flat surfaces are provided with ribs as required as described later and thus it is possible to form reinforcing parts to improve a unique design.

Figure 3:
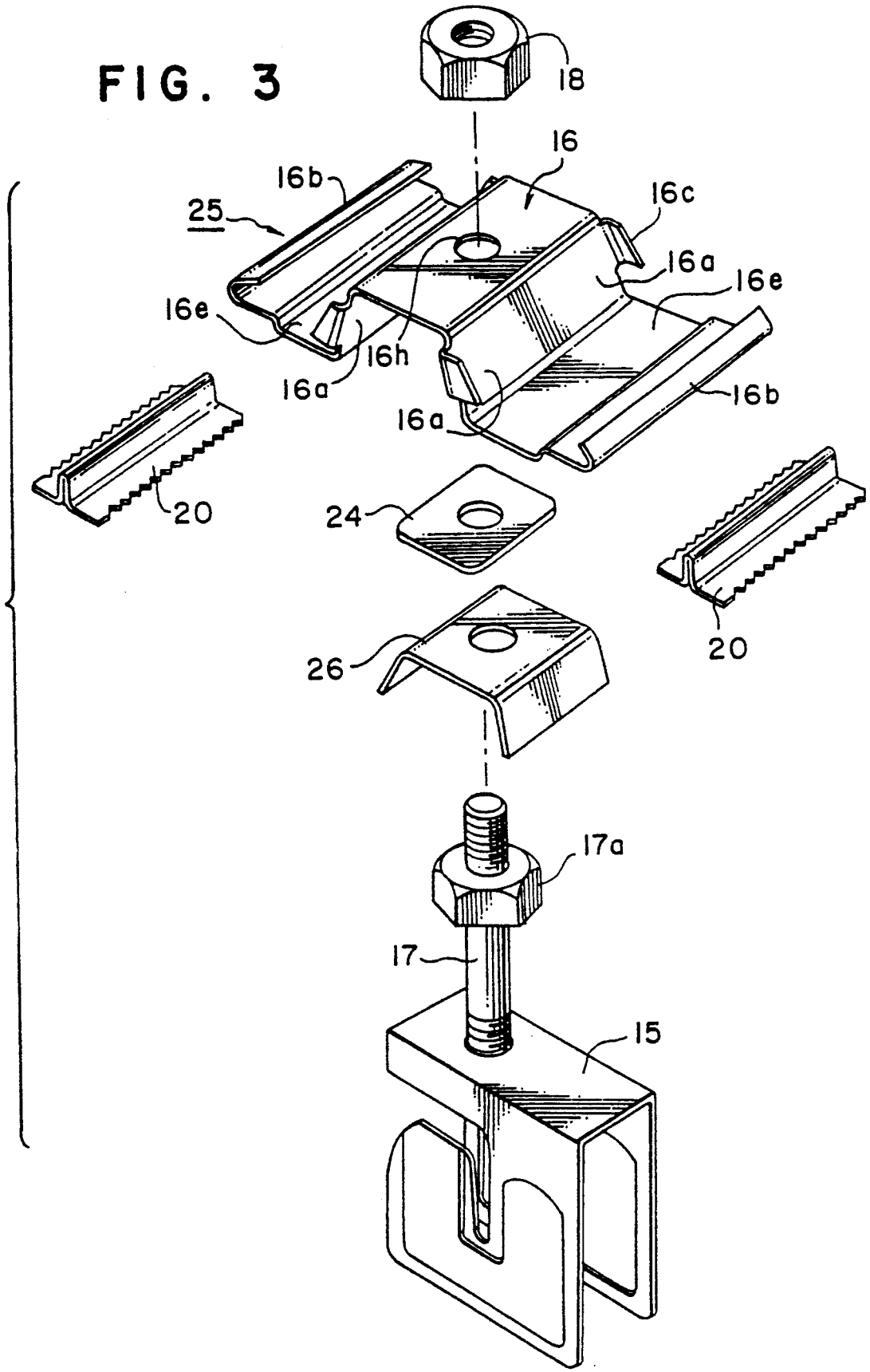

FIG. 3 is an exploded perspective view for showing the fixing member (25), in which the fixing member (25) is composed of a fitting fixing (15) of subatantial J-shape to be hooked to the backing (11), a pushing plate (16), a bolt (17), a nut (17*a*), insertion type wedge plates (20), (20), a water-proof packing (24) of rubber or resin and a fastening plate (26). The pushing plate (16) is composed of two sets of right and left engaging portions (16*a*), (16*b*), ribs (16*c*) arranged at right and left sides from a substantial upper surface of the pushing plate (16), supporting members (16*e*) between the engaging portions (16*a*) and (16*b*), and a bolt through-pass hole (16*h*). An upper bottom (13*a*) of the joint member (13) is supported on the fitting fixing (15) of substantial J-shape hooked to the backing (11). The projection (14*c*) of the drain plate (14) is arranged on the joint part of an adjoining lower inner layer material (12) through a packing (24) under the pushing plate (16). The bolt (17) passes from above the pushing plate (16) through the pushing plate (16), a packing (24), the joint member (13) and an upper side of the fitting fixing (15). A nut (17*a*) of the bolt (17) and a nut (18) are fastened together to cause the fixing fitting (15), the joint member (13) and the lower inner layer material (12) to be integrally fixed to the backing (11). A part around the projection (14*c*) of the drain plate (14) is held by the pushing plate (10) and the lower inner layer material (12). The projection (14*c*) of the drain plate (14) is tightly fastened by the pushing plate (16) and by an upper nut (18) and a middle nut (18). In addition, a more water-proof characteristic is improved through the packing (24) and the fastening plate (26) and then a rain water proofing function is further improved.

(19) denotes a metallic rafter which is arranged to cross at a right angle with the backing (11) on the lower inner layer material (12). The rafter (19) is provided with flanges (19*c*) at both sides of a substantial reversed groove through the engaging part (19*b*). To the engaging part (16*a*) of the pushing plate (16) is engaged the engaging part (19*b*) of the rafter (19), both sides of the wedge (20) are engaged with the engaging portions (16*a*), (16*b*) of the pushing plate (16) to cause the flange (19*c*) of the rafter (19) to be fastened. The rafter (19) is fixed to the lower inner layer material (12) through the pushing plate (16) and the drain plate (14). (16*c*) denotes ribs for use in engaging with the engaging part (19*b*) of the rafter arranged in the pushing plate (16). (16*h*) denotes a bolt through-pass hole arranged in the pushing plate (16).

On the rafter (19) are supported the side edges of the upper inner layer material (21) composed of wood wool plate and fixed by a proper means. The upper inner layer material (21) is placed between the rafters (19), and an air layer (22) is formed between the lower inner layer material (12) and the upper inner layer material (21). A roof plate (23) made of a long galvanized steel plate or a coated steel plate is placed laterally on the upper inner layer material (21). The roof plate (23) is supported on the rafter (19), fixed by a cut piece (19*d*) formed in the upper surface of the rafter (19) and then an opposing end part of the roof plate (23) adjacent to the eaves is engaged.

In case of the roof structure of the first preferred embodiment of the present invention constructed as described above, the part of the drain plate to be arranged within the rafter is sufficiently devised to become a water-sealed structure, so that there is no possibility that the rain water may leak under an abnormal weather condition such as a typhoon or the like and at the same time even in the case that a sufficient water-sealed structure is not provided at the first outer roof in the double roofing structure, it may be sufficiently endured against its use.

Figure 31:
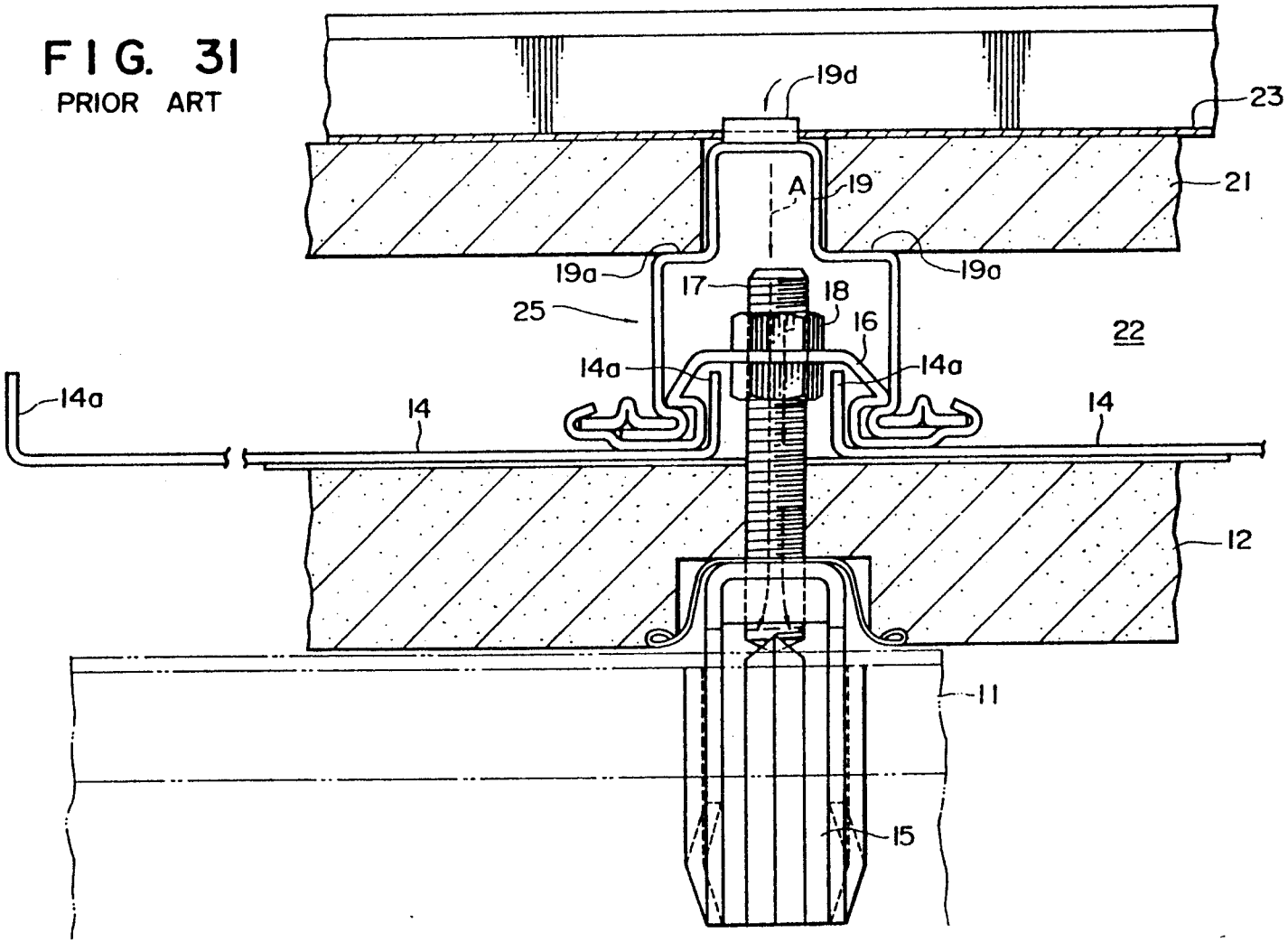
FIG. 31 PRIOR ART
FIG. 31 is a substantial front elevational view in longitudinal section for showing a prior art roof structure.

The rafter (19) shown in FIG. 2 is of a substantial hat-shape of one stage type. However, this rafter may be replaced with multi-stage type (a so-called complex rafter) having a well-known stage (19*a*) as shown in FIG. 31. Even in case of one stage type rafter (19), or two-stage type rafter (19), any type of rafters may get a roof directly on the rafter (19) and the upper inner layer material (21) such as a wood wool plate or the like may be placed or mounted at a predetermined location such as an upper end of a stage part of the rafter as required.

In the present invention, as shown in FIGS. 5 to 17, the drain plate and the pushing plate (16) of the fixing member (25) may be properly changed.

Figure 5:
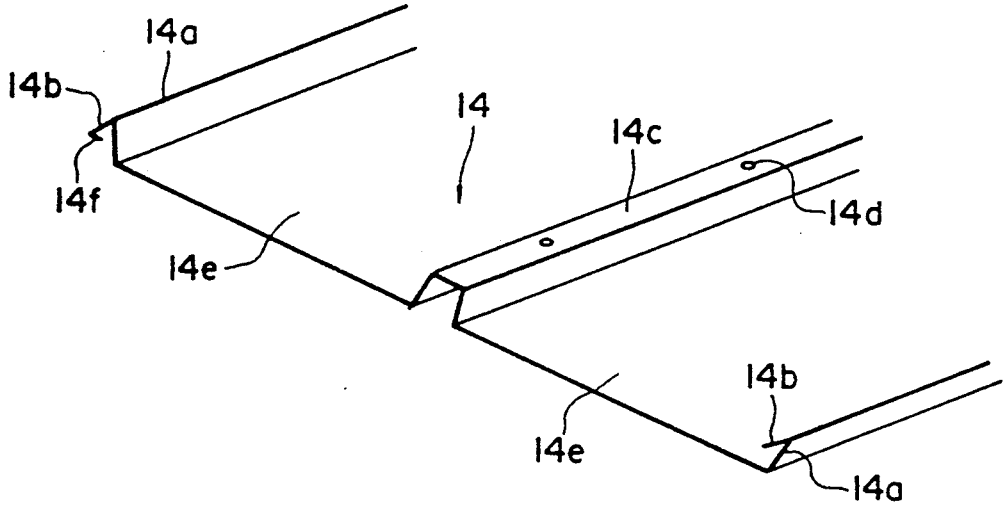

That is, FIG. 5 is a perspective view for showing a modification of the drain plate (14), wherein the right rising part (14*a*) as viewed from the upper right part in the figure of the rising parts (14), (14*a*) bent from both side edges upwardly is formed with a substantial right angle rising part in respect to the flat part (14*e*). The reason why this formation is made consists in the fact that the bent part (14*b*) is also provided with the engaging part (14*f*) in order to enable the drain plate (14) to be placed in more stable manner.

Figure 6A:
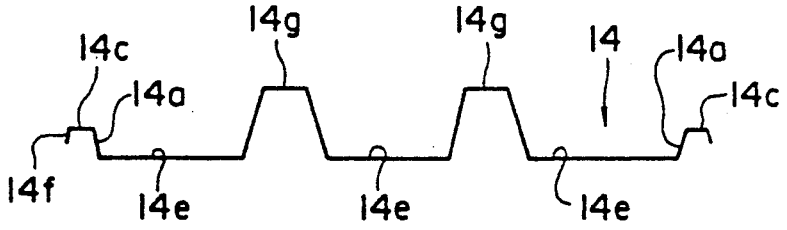
Figure 6B:
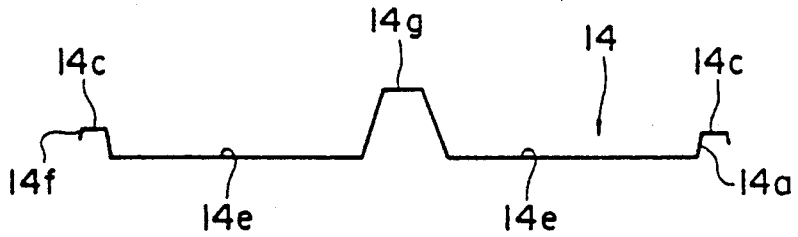
Figure 6C:
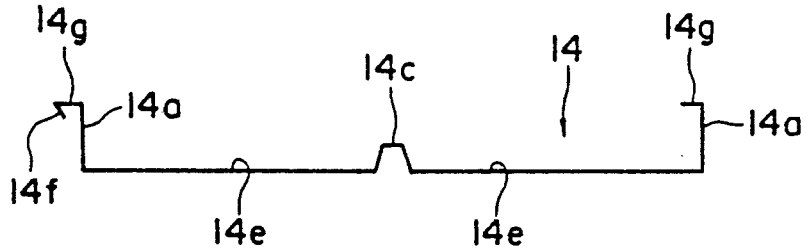
Figure 7:
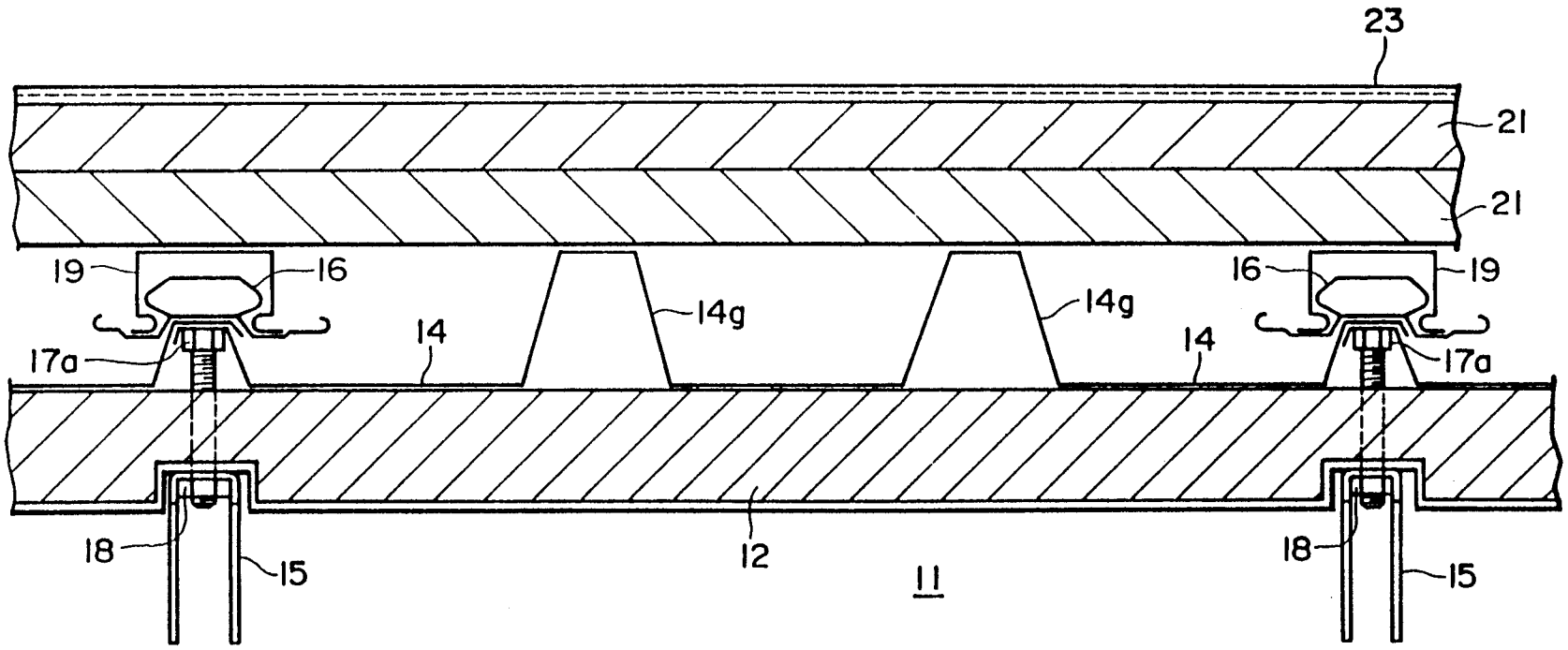

FIGS. 6(*a*), (*b*) and (*c*) illustrate a modification of the drain plate (14). FIG. 7 is a front elevational view in longitudinal section for showing a roof using the drain plate (14). That is, at the flat surfaces (14*e*) of the drain plate (14), the ribs (14*g*) having a desired shape in view of a reinforcing and design can be arranged. The ribs (14*g*) can be placed at one location in the drain plate (14) as shown in FIG. 6(*b*), two locations shown in FIG. 6(*a*)

or more than two locations as required. The ribs (14g) can be arranged to form the ribs (14g) when they are overlapped as shown in FIG. 6(c). Forming such ribs (14g) as above causes the ribs (14g) to act as a supporting part against a load even if a high load including the roof material having the upper inner layers (21) as shown in FIG. 7 and this a deformation or damage of the roof material or the upper inner layer materials can be prevented.

Figure 8:
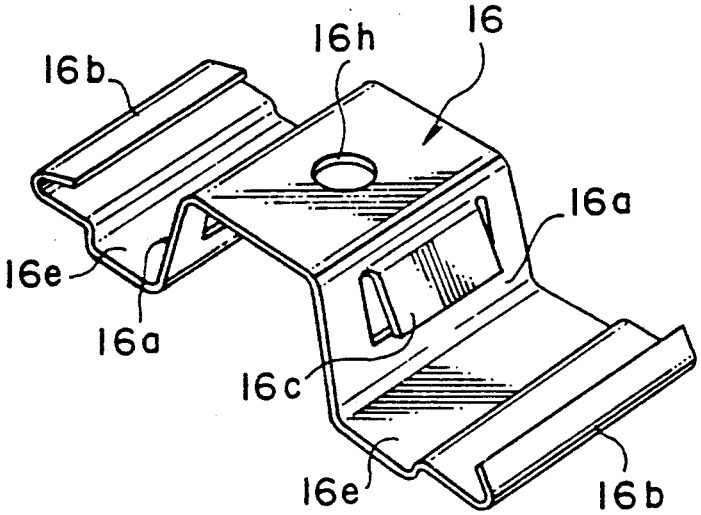
Figure 9:
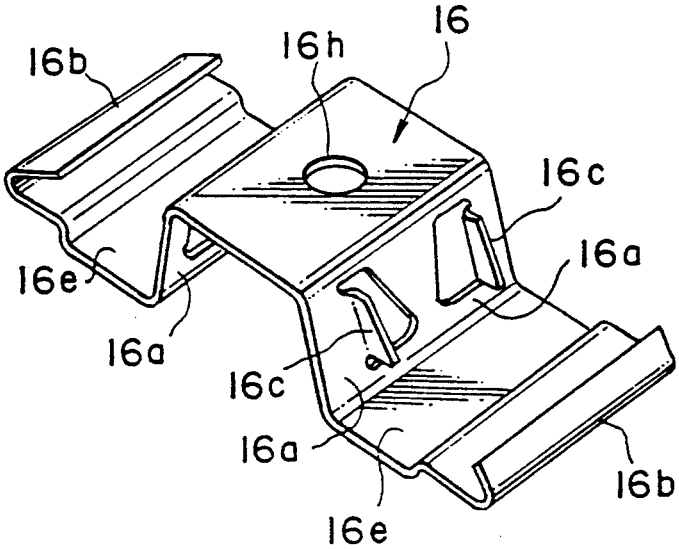

FIGS. 8 and 9 illustrate a modification of the pushing plate (16) and this is different from that of FIG. 3 only in view of the shape of the ribs (16c) of the pushing plate (16).

Figure 10:
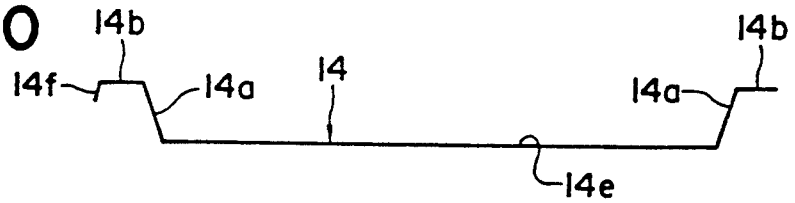
Figure 11:
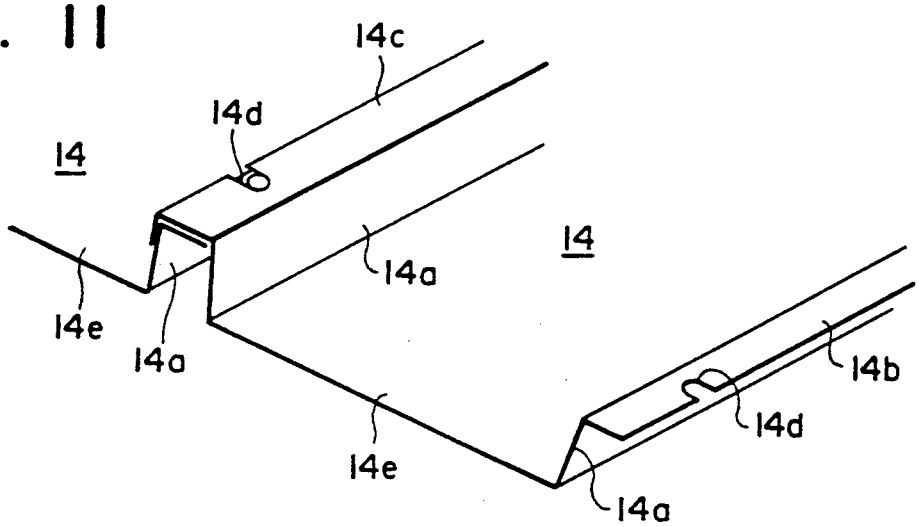
Figure 12:
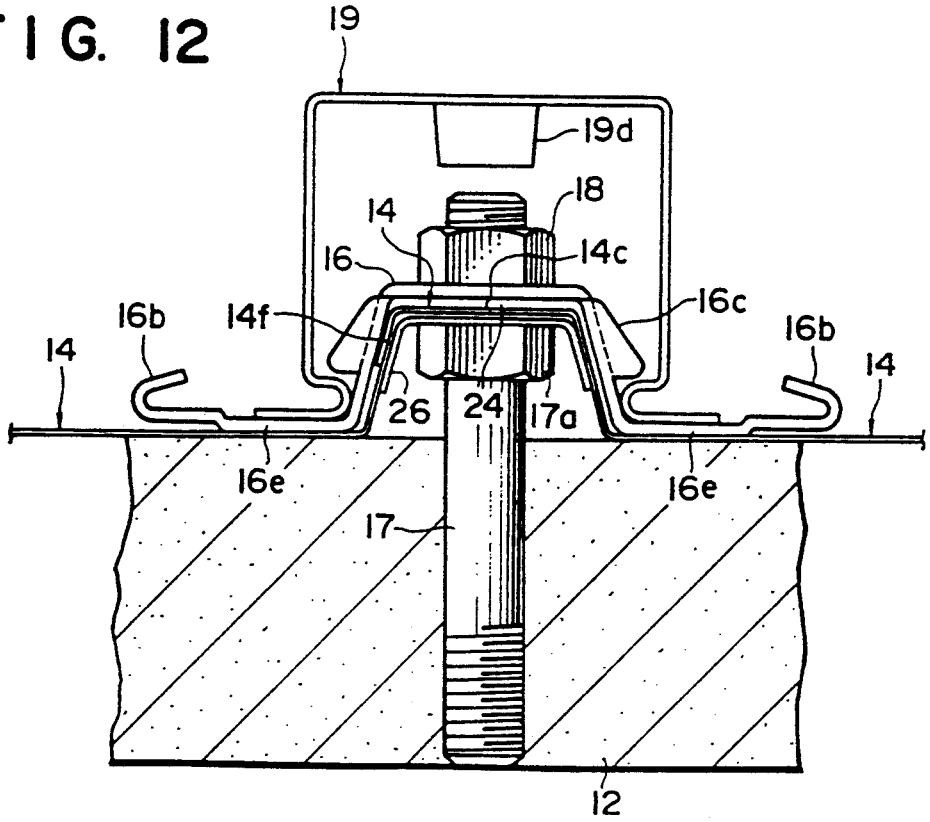

FIG. 10 illustrates another modification of the drain plate (14). in this case, this is different from that of the aforesaid drain plate (14) in view of the fact that the engaging portions of the right and left two drain plates (14), (14) are overlapped to each other. That is, one drain plate (14) is not provided with the projection (14c). Both side edges of the central flat surface (14e) are provided with the rising portions (14a), (14a) and bent portions (14b), (14b) parallel with the flat surface (14e). One of the bent portions (14b) is provided with an engaging part (14f) bent downwardly. (14d) denotes a bolt passing recess. When the two drain plates (14) formed in this way are engaged to each other, the drain plates (14), (14) formed as shown in FIG. 11 are formed and then water-sealed structure is formed while being fixed as shown in FIG. 12. The drain plate has a superior feature that its machining or transportation is easy.

Figure 13:
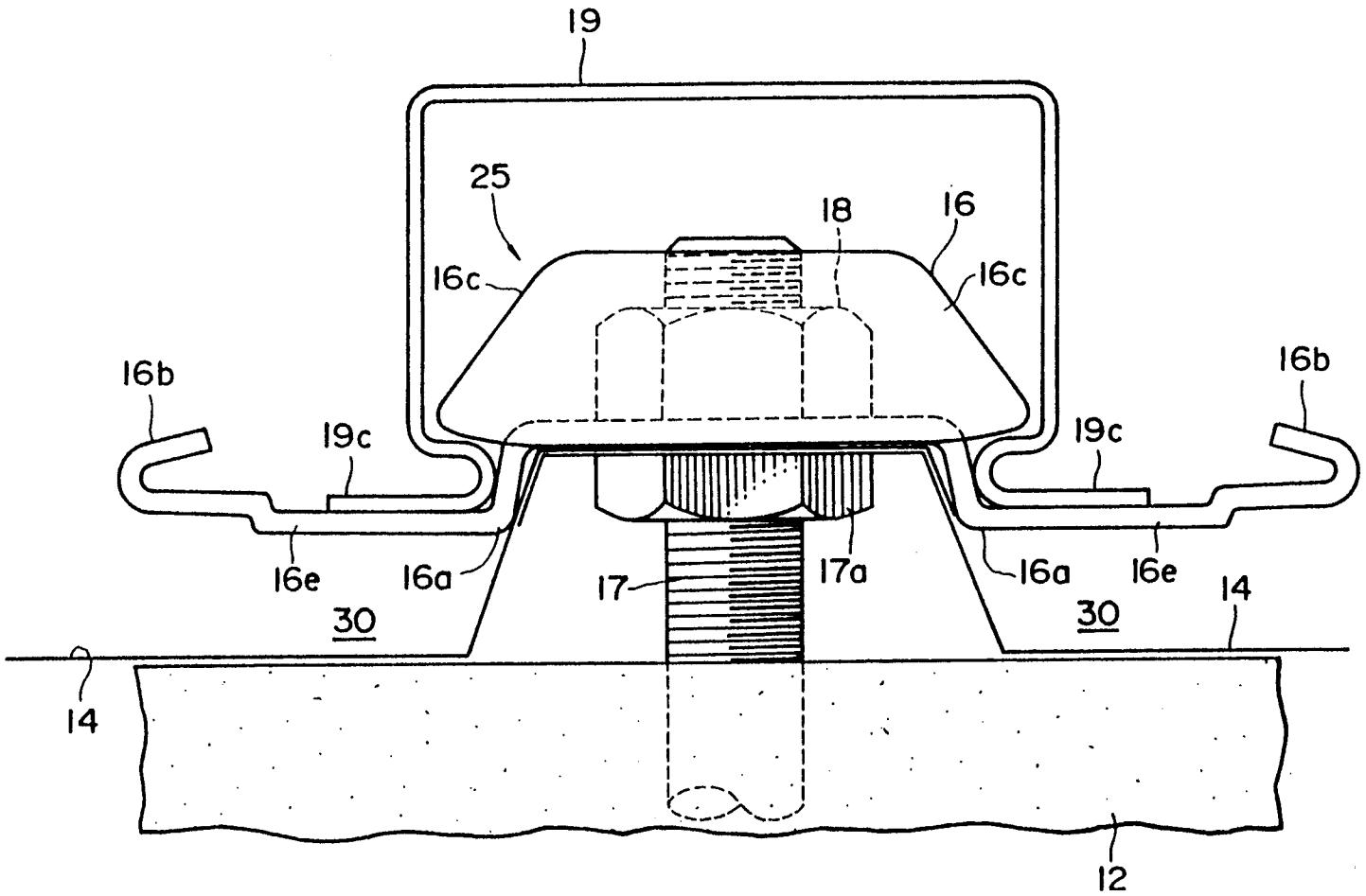
Figure 14:
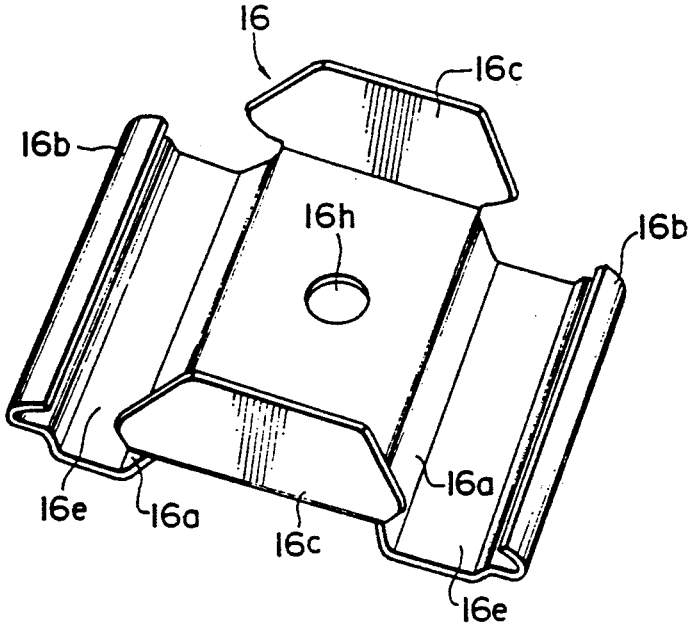

FIGS. 13 and 14 are a substantial section in a longitudinal direction of the second preferred embodiment of the present invention and a perspective view for showing the present invention. This preferred embodiment has basically the same configuration as that of the aforesaid first preferred embodiment except the shape of the pushing plate (16) constituting the fixing member (25) is different from that of the first preferred embodiment and its description concerning the common configuration is eliminated. That is, the two reinforcing plates (16c) projected over the engaging portions (16a) placed at the bolt passing hole (16b) of the two sets of right and left engaging holes (16a), (16b) arranged at the pushing plate (16) are formed into a large trapezoid in order to reinforce the pushing plate (16) and to facilitate its machining operation as shown in FIG. 14. When the rafter (19) is fixed on the supporting portions (16e) of the pushing plate (16) in accordance with the fixing order of the aforesaid first preferred embodiment under an adjustment of the bolt (17), a nut part (17a) and a nut (18), a clearance (30), i.e. an air layer part of several milimeters to several tens milimeters can be formed between the supporting portions supporting the flanges (19c) of the rafter (19) and the drain plate (14) just above the lower inner layer material (12). Formation of this spacing (30) causes the features that the upper roof including the upper inner layer material (21) has immersed water into the air layer part, i.e. the spacing (30) due to a presence of the flat plate slate and the solar panel or the like having no sufficient rain water proofing function in addition to the action and effect of the first preferred embodiment, the pushing plate supporting portions are not immersed with water, so that there is no possibility that the pushing plate is decayed and a supporting strength of the rafter is decreased and a safe state can be assured for a long period of time.

In case of the second preferred embodiment shown in FIG. 13, the right and left drain plates (14), (14) are constructed in the same manner as that shown in FIGS. 10 to 12, wherein the projection is formed when the rising portions are overlapped within the rafter. The system shown in FIG. 13 has no water-proofing member such as a packing or the like. However, the water-proofing member can be fixed as required.

Figure 15:
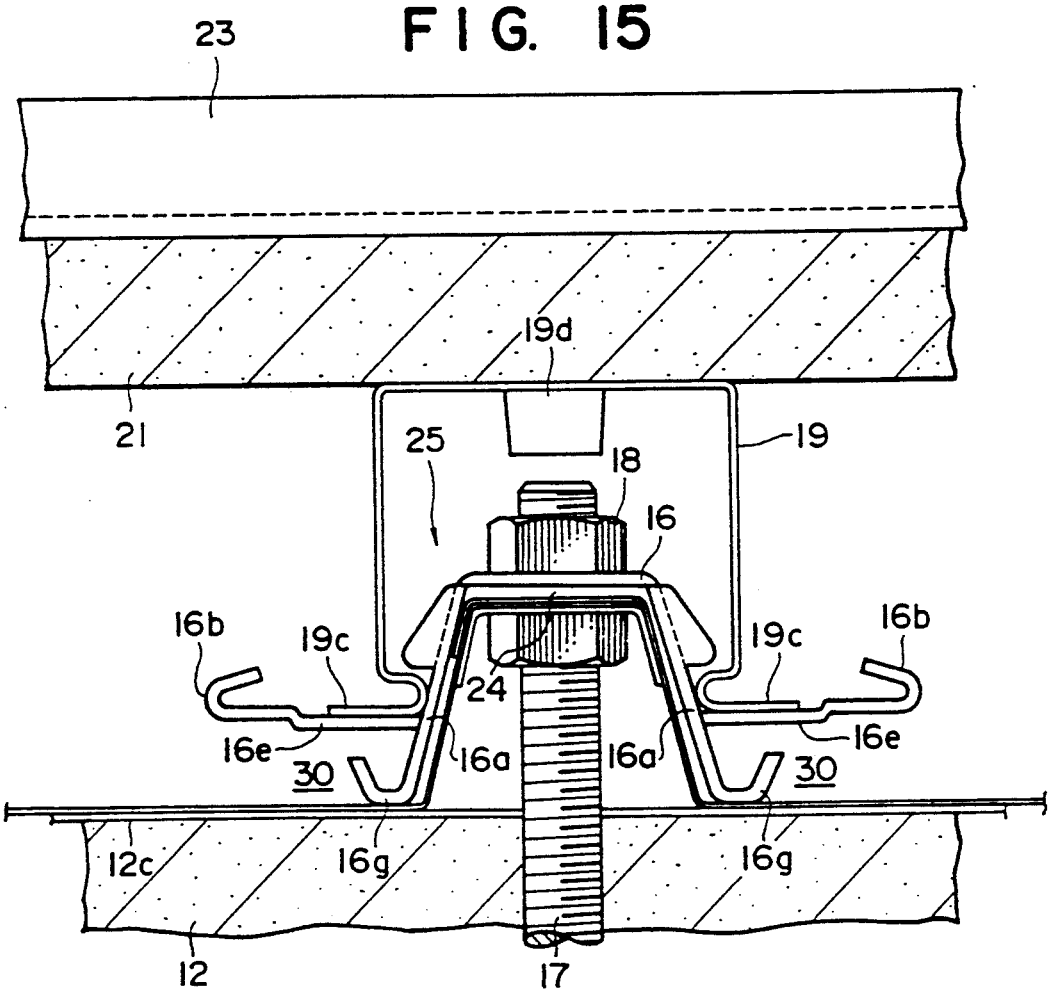
Figure 16:
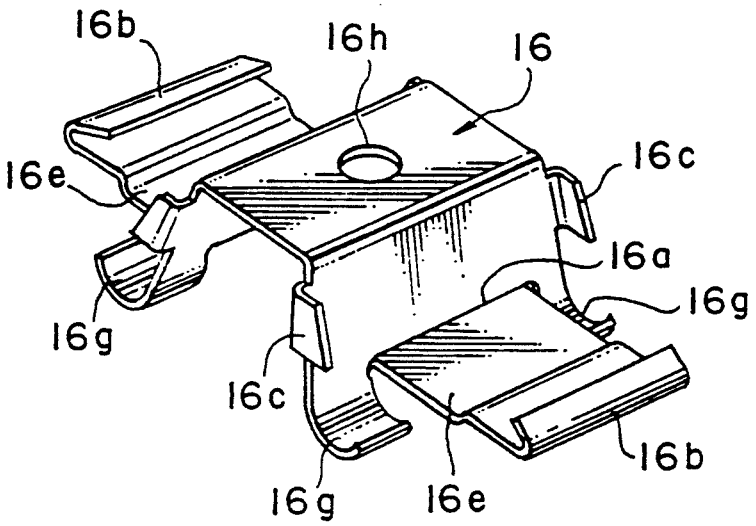
Figure 17:
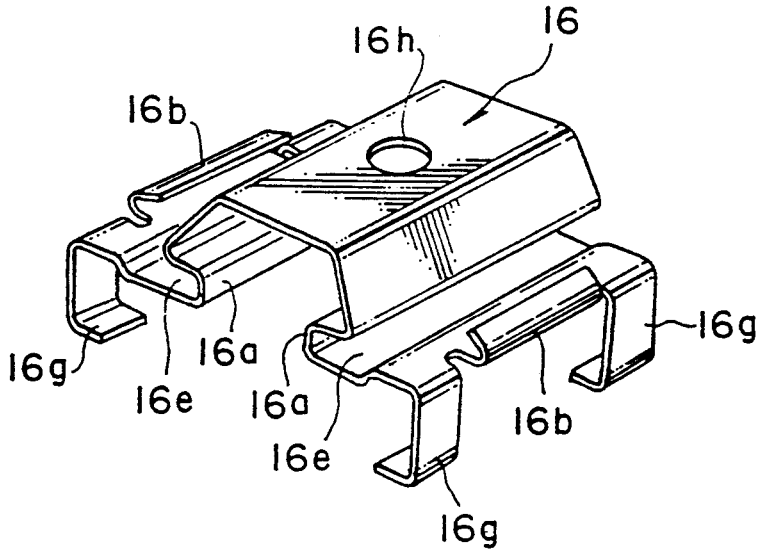
Figure 18:
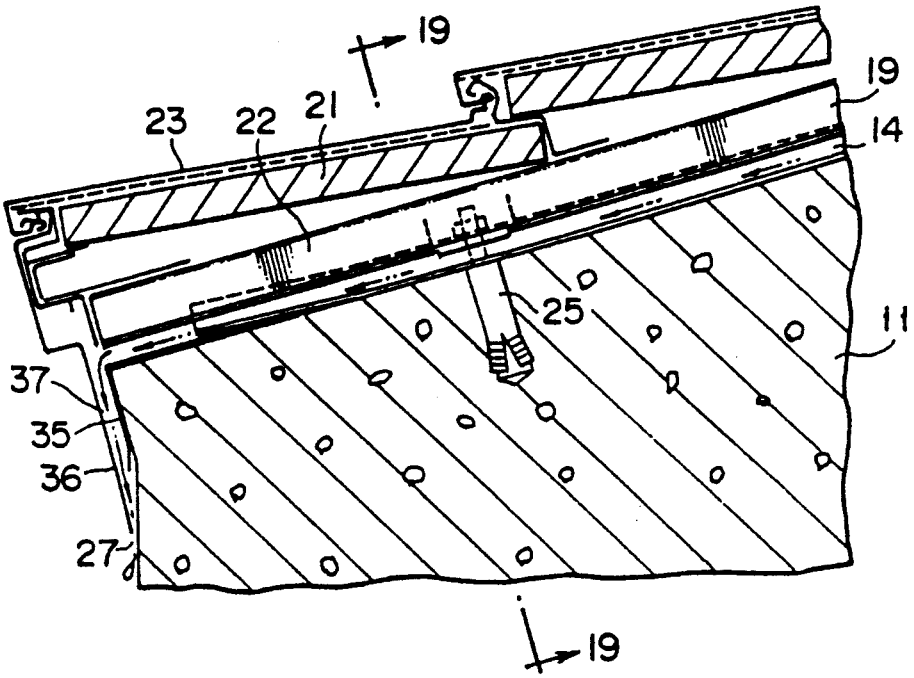
FIGS. 18 to 30 illustrate the preferred embodiments in which a backing is composed of ALC, RC and a mortar, respectively.
Figure 19:
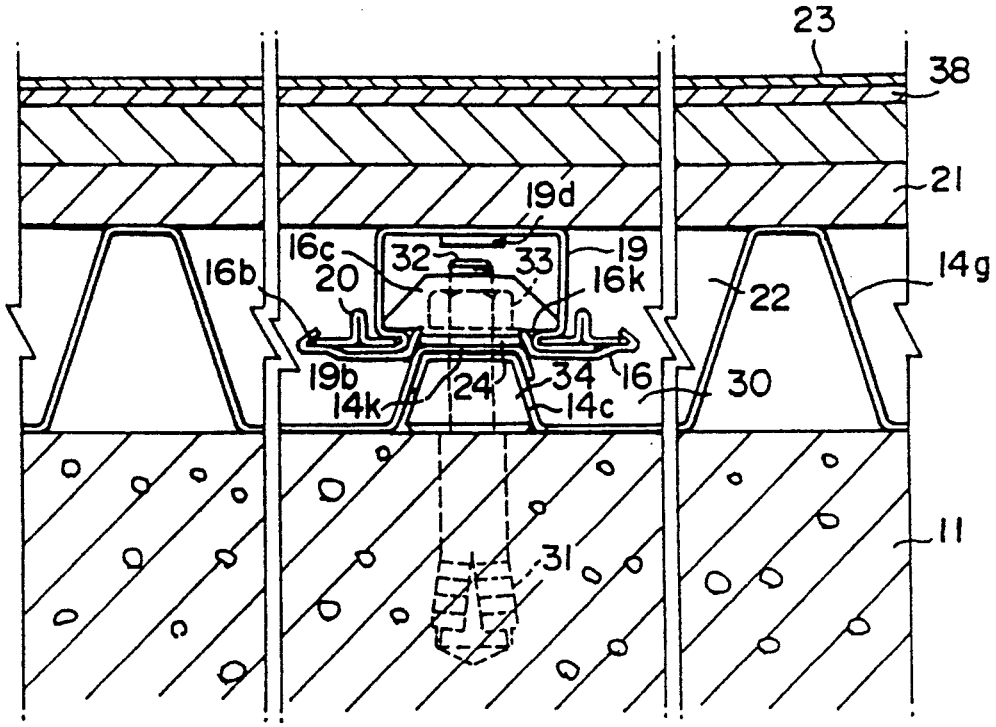
Figure 20:
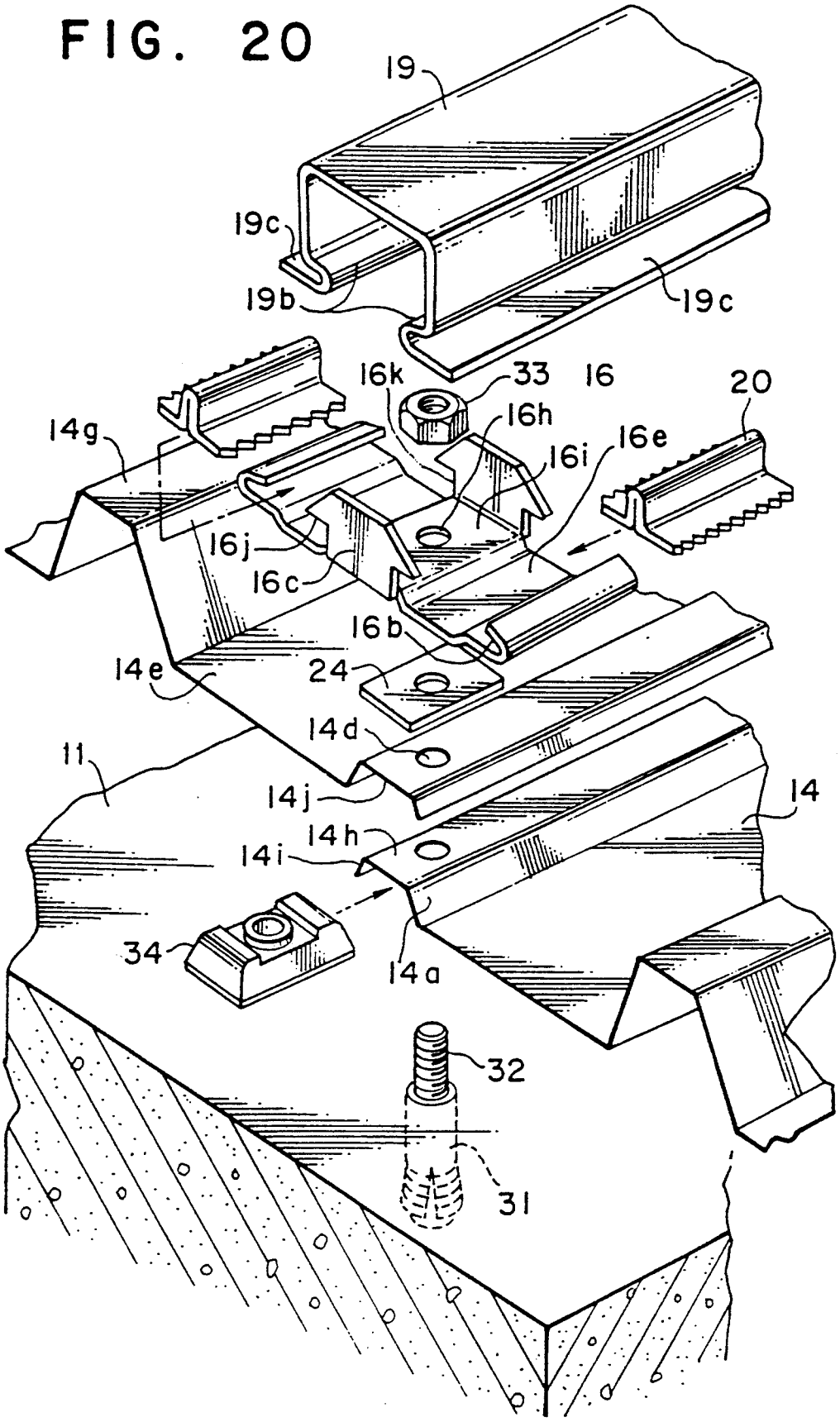
Figure 21:
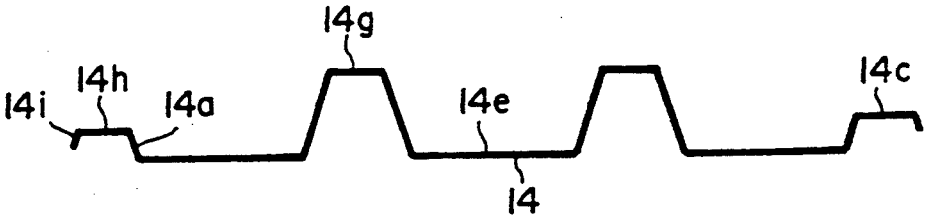

FIGS. 15 and 16 are substantial sectional views for showing the third preferred embodiment of the present invention, wherein the shape of the pushing plate (16) constituting the fixing member (25) is different from that of each of the aforesaid preferred embodiments and the configuration of the third preferred embodiment is basically the same as that of the first preferred embodiment and its common configuration is eliminated for its description. Namely, it is different from the aforesaid pushing plate that the supporting legs (16g), (16g) formed to extend downwardly by a desired size further than the rightward and leftward projecting positions of the right and left two sets of engaging portions (16a), (16b) arranged at the pushing plate (16). Accordingly, in case that the member is fixed in accordance with the aforesaid fixing order, a spacing (30) of several milimeters or several tens milimeters is generated between the supporting legs (16g) and the engaging portions (16a), (16b). In the third preferred embodiment, in addition of the action and effect of the first preferred embodiment, it has the action and effect of the second preferred embodiment and thus a simple alignment can be assured by changing the height of the supporting leg (16g) of the pushing plate (16) without forming by aligning the height of the rafter with the height of the air layer of various roofs. In addition, four supporting legs (16g) are placed at one pushing plate (16) and these are rigidly fastened to the housing (11) with bolts for every desired spacings, resulting in that in view of its strength, it is not deteriorated as compared with that of the first preferred embodiment. FIG. 17 illustrates a modification of the pushing plate (16) of the third preferred embodiment, wherein it has a similar function of that of the pushing plate (16) shown in each of the preferred embodiments except the shape of the supporting legs (16g) is different from the shape of the engaging portions (16a).

In case of the double roofing structure of the fourth preferred embodiment shown in FIGS. 18 to 21, male screw anchors 31 of the fixing member 25 are struck from the ridge side to the eaves at a proper spacing to the backing of the roof of ALC panel, and the bolts 32 of each of the male screw anchor 31 are projected to the upper surface of the backing 11 and arranged in side-by-side relation on a linear line toward the eaves and ridges. The drain plate 14 is arranged over an entire roof surface from the ridge to the eaves in such a way as the side edges of the adjoining right and left drain plates are coincided to each of the bolts 32.

The drain plate 14 is composed of a water-proof material such as thin metallic plate of iron, aluminum or thick foil and a thin plate of synthetic resin and the like. The drain plate 14 is divided into a plurality of segments toward the ridges and eaves and the eaves ends of the drain plate 14 at the ridge are overlapped on the ridge end of the divided drain plate 14 at the eaves.

The drain plate 14 has a rising part 14j composed of rising portions 14a bent from both right and left side edges in slant upward directions, a horizontal portion 14h bent from the upper ends of the rising portions 14a outwardly in a horizontal manner, and a depending part 14i bent from the horizontal portion 14h downwardly. The right and left rising portions 14j are made such that both horizontal portions 14h are overlapped vertically to form the projection 14c of a trapezoid section. The projection 14c is fixed by passing the bolt 32 into the hole recess 14d passing vertically at the horizontal part 14h and the pushing plate 16 of the fixing member 25 is fastened and fixed to the bolt 32 passing on the projection 14c with a nut 33, the projection 14c is fixed by the pushing plate 16 to the male screw anchor 31 and then the pushing plate 16 is fixed to the male screw anchor 31.

The projection 14c is formed such that the top part 14k acting as a part arranged inside the rafter 19 to be described later is formed to a similar shape of a sectional shape of the pushing plate portion 16i of the pushing plate 16, it is closely contacted to the pushing plate portion 16i without any clearance and then a water-prrof member 24 such as a packing of rubber or resin is placed between the top part 14k and the pushing plate portion 16i. In addition, at the rear side of the projection 14c is placed a spacer member 34 having a substantial similar shape to that of the spacing sectional shape formed by the inside part of the projection, i.e. a substantial trapezoid sectional shape. A rib 14g is projected toward the ridge and eaves at the flat surface 14e between the right and left projections 14c, the flat surface 14e is reinforced by the rib 14g and the upper inner layer material 21 to be described later is supported by it.

The pushing plate 16 is made such that a bolt 32 passes through a central through-pass hole 16h of a pushing plate 16i having a substantial trapezoid section. The pushing plate 16i is made such that the supporting partion 16e is extended in a horizontal direction from the outward slant downward right and left edges and either the right or left side edge of the supporting portion 16e is bent upwardly to form the engaging part 16b. Reinforcing plates 16c having a substantial trapezoid section are vertically arranged at aft and fro horizontal side edges of the pushing plate 16i, and the jaw-like engaging portions 16j at the right and left lower edges of the reinforcing plate 16c form the engaging concave portions 16k between it and the lower supporting portion 16e.

The rafter 19 is of a metallic substantial gate-shaped section member, its right and left lower edges are provided with the inner bent engaging portions 19b and at the same time it is provided with each of the flanges 19c extending from the engaging portions 19b outwardly in a horizontal direction. The right and left engaging portions 19b of the rafter 19 are held and engaged with the engaging concave portions 16k at the pushing plate 16. The right and left flanges 19c are placed on the supporting portions 16e and supported by them. To the engaging portions 19b and the engaging portions 16b are engaged both sides of the wedge plates 20 so as to keep the engaged state of the engaging portions 19b of the rafter 19 against the engaging concave portions 16k of the pushing plate 16. The rafter 19 is fixed to the backing 1 of ALC panel through the pushing plate 16 and the drain plate 14 with the male screw anchor 31.

An upper inner layer material 21 composed of wood wool plate is supported on the rafter 19 and fixed with a proper means and a spacing layer 22 is formed between the upper inner layer material 21 and the drain plate 14. On the upper inner layer material 21 is placed a roof material 23 composed of a long metallic roof plate such as a galvanized steel plate and a coated steel plate and the like in a lateral orientation, the roof material 23 is supported on the rafter 11 and fixed by a recessed piece 19d formed on the upper surface of the rafter 19, thereby the opposing ends of the roof material 23 adjacent in a ridge and eaves direction are engaged.

The spacing layer 22 has small spacings 30 between the supporting portions 16e and the drain plate 14 supporting the flanges 19c of the rafter 19 in addition to the spacing between the upper inner layer material 21 and the drain plate 14. The small spacings 30 form a part of the spacing layer 22 so as to guide the drain water to prevent accumulation of water in the supporting portions 16e and the pushing plate 16. The eaves ends of the spacing layer 22 and the small spacings 30 are communicated with the drain port 27 at the lower end of the drain passage 37 through the drain passage 37 between the throating plates 35 and 36 vertically arranged from the eaves sides of the drain plate 14 and the upper inner layer material 21.

Reference numeral 38 denotes a water-proofing material of felt and this is placed between the upper inner layer material 21 and the roof material 23 as required. Material quality of the aforesaid spacer material 34 is of rubber, resin and metal or the like and this is properly selected in reference to a prevention of deformation of the projection 14c and an assurance of water-sealed state.

With such an arrangement, in case of the double roofing structure of the fourth preferred embodiment, a water leakage is not expected even under an abnormal weather condition such as a typhoon by applying a sufficient arrangement of the drain plate to be arranged inside the rafter 19 as the water-sealed structure and at the same time in case that a sufficient water-sealed structure is not attained, a sufficient endurance may be attained with the second roof. In addition, even if the immersed water from the first roof to the spacing layer 22 and the small spacings 30, the supporting portions 16e are not wetted with water, so that there is no possibility that the supporting portions 16e are decayed and the supporting strength of the rafter 19 is decreased and a safe state can be assured for a long period of time.

Figure 22:
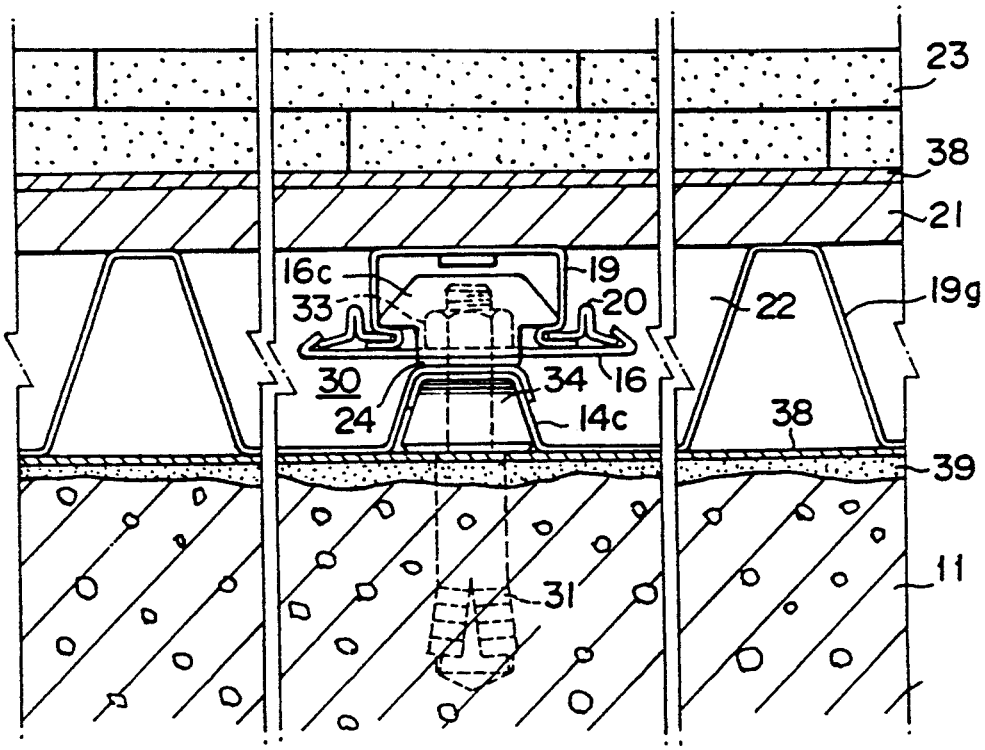
Figure 23:
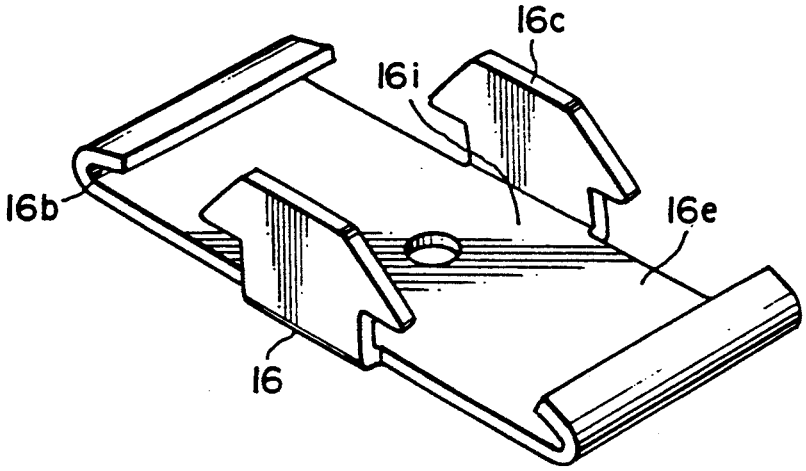

In case of the double roofing structure illustrated in FIGS. 22 and 23, this is basically the same configuration as that of the aforesaid fourth preferred embodiment except a certain configuration and its common configuration will be eliminated for its description.

The backing 11 is of RC and the upper surface is provided with a level adjusting mortar 39. A water-proofing material 38 of asphalt system is placed between the backing 11 and the drain plate 14 so as to prevent the backing 11 from being damaged with wet vapor. The pushing plate 16 is made such that the pushing plate portion 16i is formed at the same height horizontal state as that of the supporting portion 16e. A small spacing 30 between the supporting portion 16e and the drain plate 14 is formed large, a throating operation is further improved to make a complete countermeasure against decay of the supporting portion 16e. The upper inner layer material 21 is of a plywood and a roofing material 23 composed of slate is placed on the upper inner material 21 through the water-proofing material of asphalt.

In case of the double roofing structure of the fifth preferred embodiment, even if the first outer roof is of a flat plate slate having no sufficient water-proofing function in addition to the action and effect of the aforesaid fourth preferred embodiment, the water immersed into the spacing layer 22 and the small spacing 30 can be drained from the eaves to the outer area positively.

Figure 24:
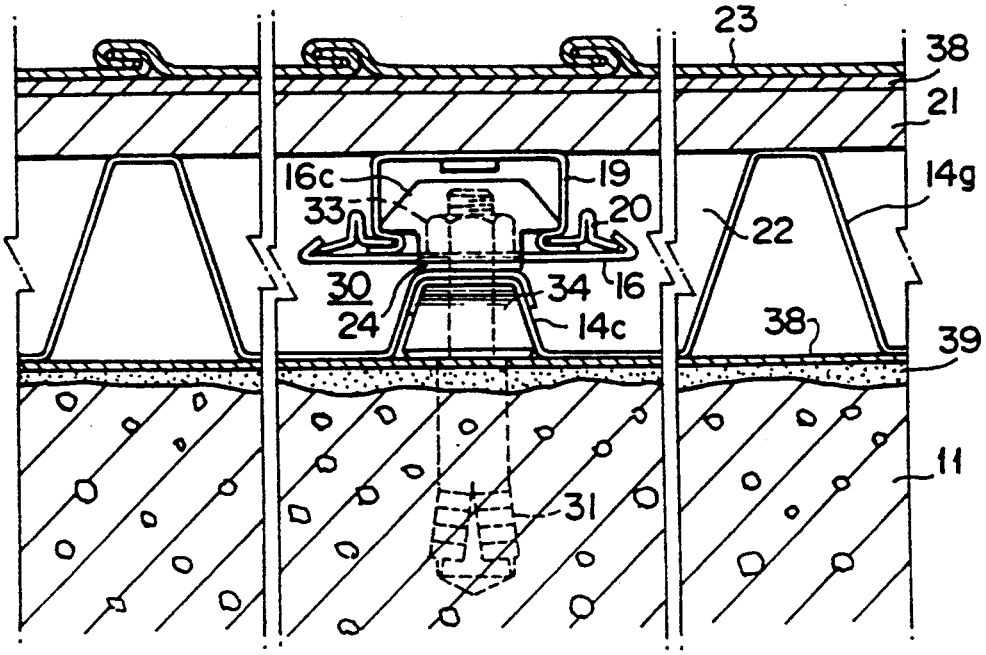

The double roofing structure of the sixth preferred embodiment shown in FIG. 24 is basically the same configuration as that of the aforesaid fifth preferred embodiment except the fact that the roof material 23 is a flat metallic roof plate and its common configuration is eliminated for its description.

The double roofing structure of the sixth preferred embodiment also has the similar action as that of the fifth preferred embodiment.

Figure 25:
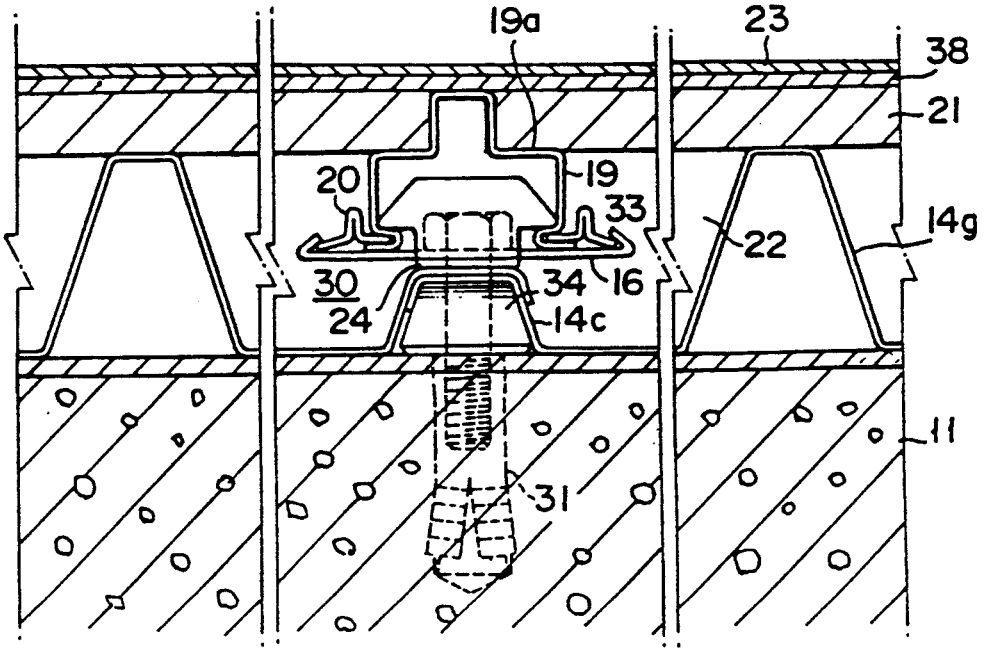
Figure 26:
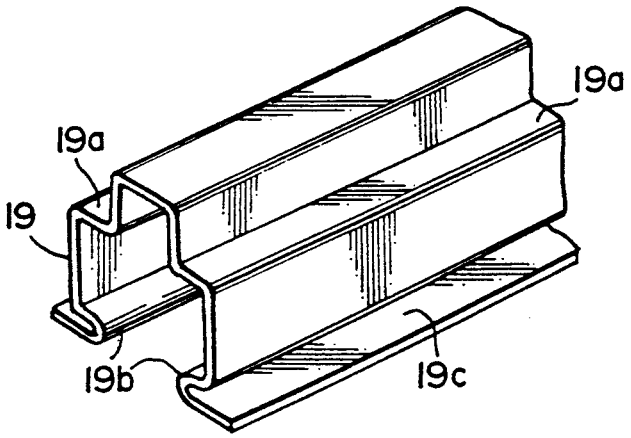
Figure 27:
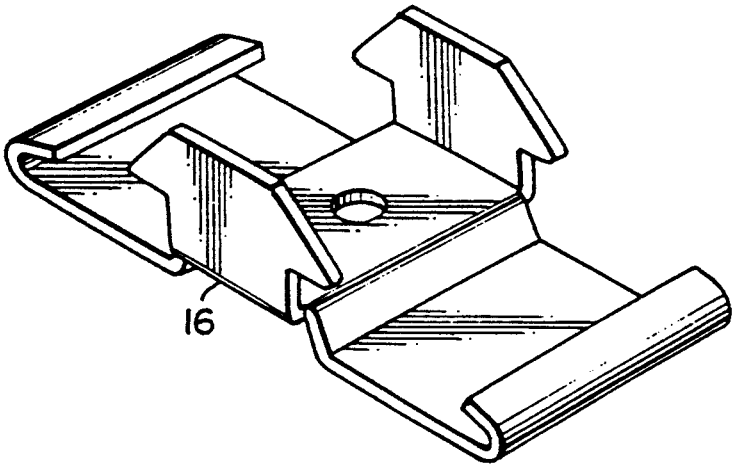

In case of the double roofing structure of the seventh preferred embodiment shown in FIGS. 25 to 27, it is basically the same configuration as that of the fourth preferred embodiment except a part of the ocnfiguration, and its common configuration will be eliminated for its description.

Reference numeral 31 denotes a female screw anchor, the rafter 14 has step portions 19*a* between the upper end and the side part and the step portions 19*a* have the upper inner layer material 21 at its side edge mounted thereon.

The double roofing structure of the seventh preferred embodiment as described above also has the similar action and effect as those of the aforesaid fourth preferred embodiment.

Figure 28:
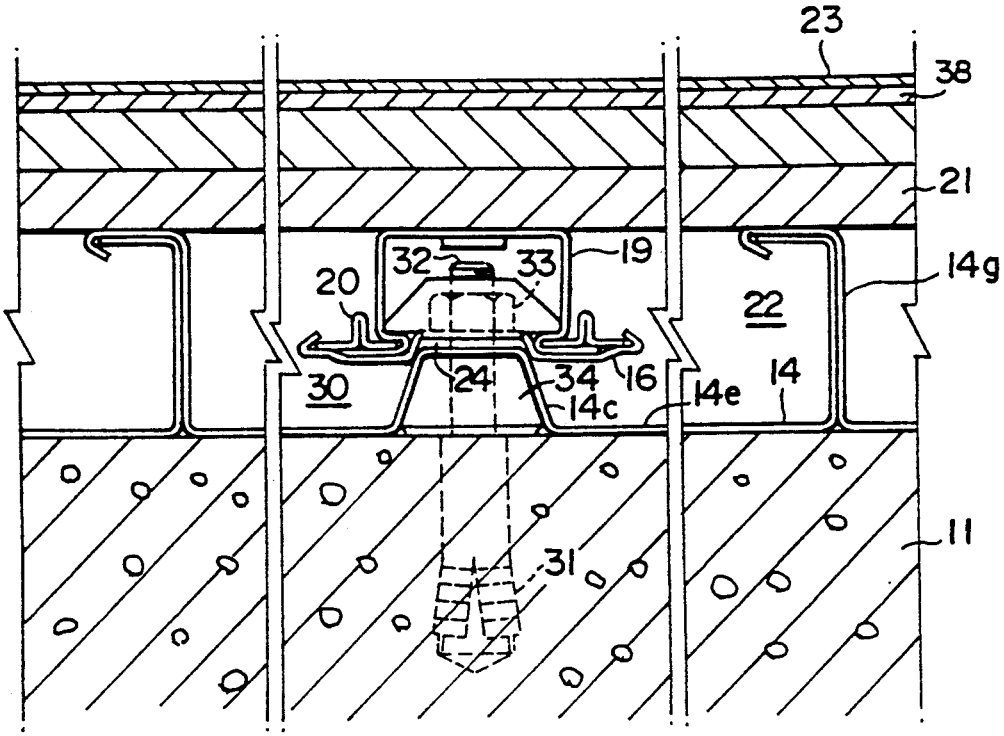

In case of the double roofing structure of the eighth preferred embodiment shown in FIG. 28, this is basically the same configuration as that of the fourth preferred embodiment except a certain configuration and a description of the common configuration will be eliminated.

The drain plate 14 is made such that the projection 14*c* is projected at a central part between the ribs 14*g* at the flat surface 14*e*.

In case of the double roofing structure of the eighth preferred embodiment, the projection 14*c* is an integral structure in addition to the action and effect of the fourth preferred embodiment and there is no clearance to face against the spacing layer 22 and the small spacing 30, thereby an immersion of water into the backing 11 can be prevented completely.

Figure 29:
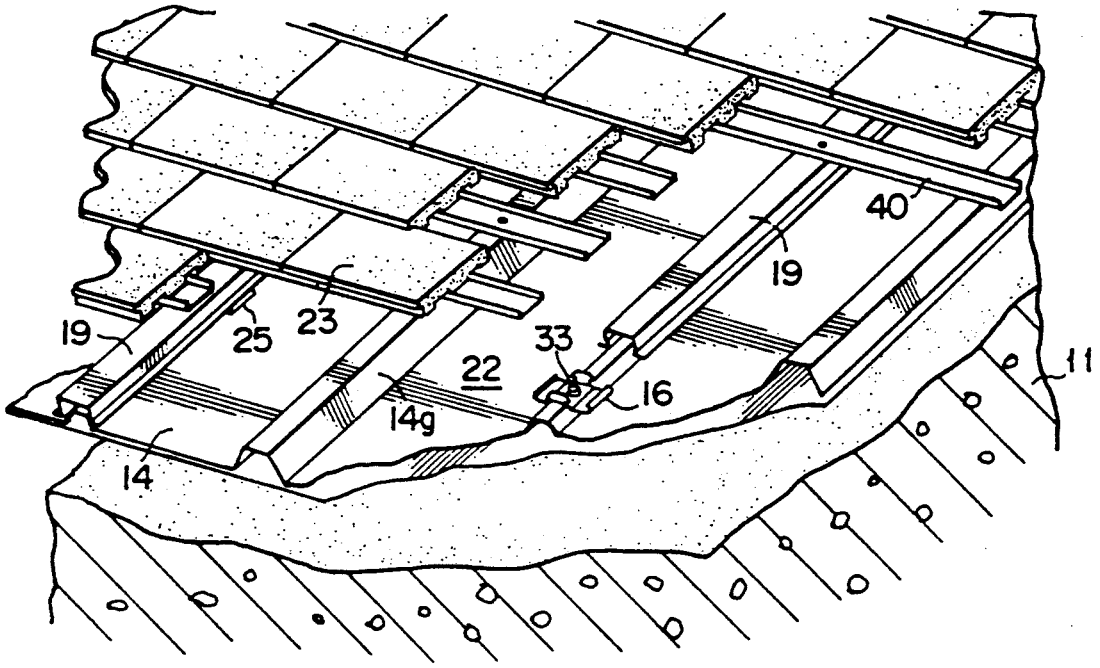
Figure 30:
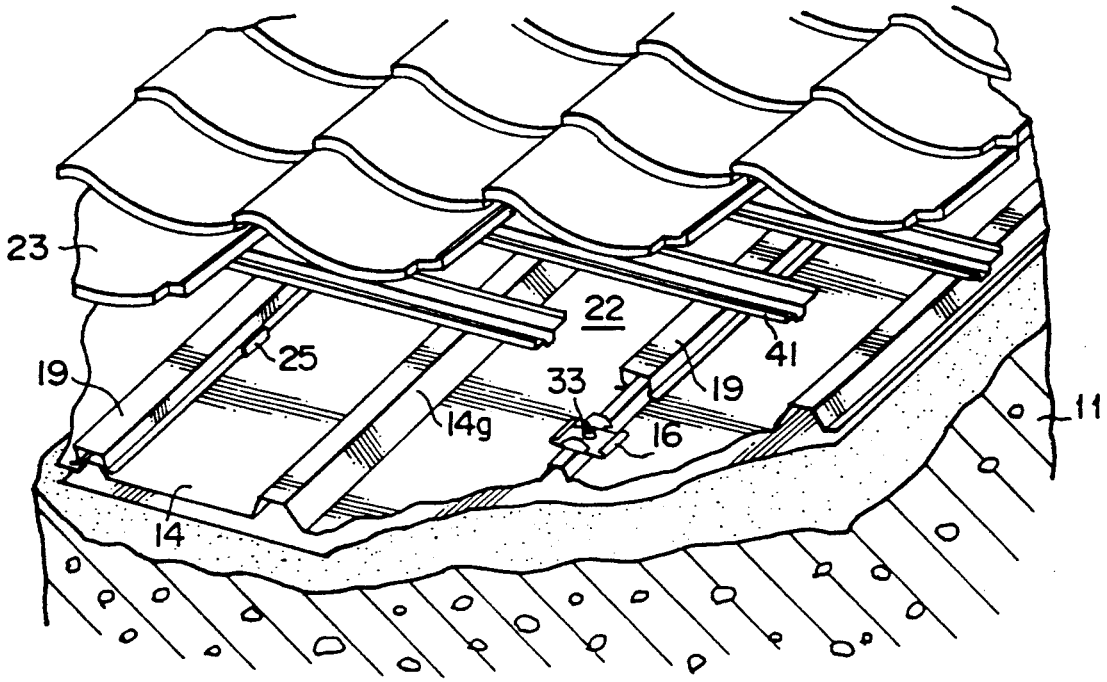

In case of the double roofing structure of the ninth preferred embodiment illustrated in FIG. 29, this is basically the same as that of the fourth preferred embodiment except that the roof material 23 is of a ceramic tile and its common configuration will be eliminated for its description.

Rails 40 to which the ceramic tile can be fixed over each of the rafters 19 are arranged in a horizontal orientation toward the ridge and then the roof material 23 of the ceramic tile is fixed to the rails 40.

In case of the double roofing structure of the ninth preferred embodiment shown in FIG. 10, this is basically the same configuration as that of the fourth preferred embodiment except the roof materials 23 are Japanese roof tiles and its common configuration will be eliminated for its description.

The rails 41 to which the Japanese roof tiles can be fixed and over each of the rafters 19 are arranged in parallel toward the ridge, and to the rails 41 are fixed the Japanese roof tiles 23.

In case of the double roofing structure of the tenth preferred embodiment, the roof surface can be provided with some tiles in addition to the action and effect of the fourth preferred embodiment.

What is claimed is:

1. A double roofing structure comprising:

a water-proof drain plate set on at least one backing;

a rafter fixed on the backing through the drain plate with a fixing member that has a pushing plate having a substantial channel shape;

a roof member placed and fixed on the rafter;

a spacing layer, communicating with an opening at an eave of the roofing structure, formed between the drain plate set on the backing and the roof member;

a projection formed on a part of the drain plate contacting with the fixing member, the projection of the drain plate being formed in substantially a same sectional shape as the pushing plate of the fixing member contacting with the projection; and a water-proof member positioned between the pushing plate of the fixing member and an upper surface of the projection of the drain plate.

2. A double roofing structure according to claim 1, wherein the drain plate further includes right and left side edges and rising portions at the right and left side edges, the projection of the drain plate being formed between the rising portions.

3. A double roofing structure according to claim 1, wherein the drain plate further includes a plurality of engaging plates that each include rising portions at their respective right and left side edges, wherein the projection is formed by overlapping adjoining rising portions of the plates below the rafter.

4. A double roofing structure according to claim 1, wherein a flat surface of the drain plate is provided with one or more ribs for supporting the roof member.

5. A double roofing structure according to claim 1, wherein flanges of the rafter are closely contacted with the drain plate through the engaging portions of the pushing plate of the fixing member.

6. A double roofing structure according to claim 1, wherein flanges of the rafter are supported by the supporting portion of the pushing plate mounted on the drain plate.

7. A double roofing structure according to claim 1, wherein flanges of the rafter are supported at the supporting portions of the pushing plate mounted on the drain plate, a spacing is formed just below the supporting portions and the pushing plate is supported on the drain plate by supporting legs arranged on the pushing plate.

8. A double roofing structure according to claim 1, wherein the rafter is provided with a step part between an upper and aside surface of the rafter.

9. A double roofing structure according to claim 1, further comprising a thermal insulation material placed between the backing and the draining plate.

10. A double roofing structure according to claim 1, wherein the roof member includes roof material of metal, pile, slate or roof tile.

11. A double roofing structure according to claim 1, wherein the backing is made of a steel of a predetermined sectional shape and a lower inner layer material is placed on the backing.

12. A double roofing structure according to claim 1, wherein the backing is air-bubbled lightweight concrete, concrete or mortar.

13. A double roofing structure according to claim 1, wherein the roof member comprises a roof plate and a roof plate holding member.

14. A double roofing structure according to claim 1, wherein the roof member comprises a roof plate and an inner layer of material for supporting the roof plate.

15. A double roofing structure according to claim 1, wherein the drain plate further includes a plurality of engaging plates that each include rising portions at their respective right and left side edges, wherein adjoining rising portions of each of the engaging plates overlap with one another along a direction parallel to the rafter.

16. A double roofing structure comprising:

a water-proof drain plate supported by at least one backing;

a rafter fixed on the backing through the drain plate with a fixing member;

a roof member placed and fixed on the rafter;

a spacing layer, communicating with an opening at an eave of the roof structure, formed between the drain plate set on the backing and the roof member;

a projection formed on a portion of the drain plate contacting with the fixing member; and a spacer member provided between an inner side of the projection of the drain plate and the fixing member and having a substantially trapezoidal sectional shape.

17. A double roofing structure according to claim 16, wherein the spacer member is rubber, resin or metal and prevents deformation of the projection and provides a water-sealed state.

* * * * *